US006147017A

United States Patent [19]

Fastenau et al.

[11] Patent Number: 6,147,017

[45] **Date of Patent: *Nov. 14, 2000**

[54] INDUSTRIAL FIBERS WITH SINUSOIDAL CROSS SECTIONS AND PRODUCTS MADE THEREFROM

[75] Inventors: Robert Francis Fastenau, Kinston; Mark Ashley Short, Grifton, both of N.C.

[73] Assignee: E. I. du Pont de Nemours and Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/806,177

[22] Filed: Feb. 26, 1997

[51] Int. Cl.[7] ..... B32B 9/00

[52] U.S. Cl. ..... 442/192; 428/392; 428/397

[58] Field of Search ..... 442/192; 428/392, 428/397

[56] References Cited

U.S. PATENT DOCUMENTS

| | | | |
|---|---|---|---|
| 2,071,251 | 2/1937 | Carothers | 18/54 |
| 2,464,746 | 3/1949 | Gering | 264/177.17 |
| 2,465,319 | 3/1949 | Whinfield et al. | 260/75 |
| 2,985,995 | 5/1961 | Bunting, Jr. et al. | 57/140 |
| 3,060,504 | 10/1962 | Thomas et al. | 425/461 |
| 3,164,948 | 1/1965 | Stratford | 264/177.13 |
| 3,216,187 | 11/1965 | Chantry et al. | 57/140 |
| 3,249,669 | 5/1966 | Jamieson | 264/177.13 |
| 3,914,488 | 10/1975 | Gorrafa | 428/397 |
| 4,003,974 | 1/1977 | Chantry et al. | 264/210 F |
| 4,025,592 | 5/1977 | Bosley et al. | 264/78 |
| 4,054,709 | 10/1977 | Belitsin et al. | 264/177.13 |
| 4,083,914 | 4/1978 | Schippeis et al. | 264/147 |
| 4,134,951 | 1/1979 | Dow et al. | 264/147 |
| 4,332,761 | 6/1982 | Phillips et al. | 264/177.13 |
| 4,590,032 | 5/1986 | Phillips | 264/177.13 |
| 4,622,187 | 11/1986 | Palmer | 264/103 |
| 4,634,625 | 1/1987 | Franklin | 428/258 |
| 4,680,191 | 7/1987 | Budd et al. | 475/461 |
| 4,842,792 | 6/1989 | Bagrodia et al. | 264/130 |
| 4,945,151 | 7/1990 | Goodley et al. | 528/272 |
| 5,006,057 | 4/1991 | Bagrodia et al. | 264/177.13 |
| 5,077,124 | 12/1991 | Clark, III et al. | 428/364 |
| 5,106,946 | 4/1992 | Clark, III et al. | 528/335 |
| 5,139,729 | 8/1992 | Clark, III et al. | 264/289.6 |
| 5,294,482 | 3/1994 | Gessner | 428/287 |
| 5,593,768 | 1/1997 | Gessner | 428/286 |

FOREIGN PATENT DOCUMENTS

| | | | |
|---|---|---|---|
| 43-523 | 1/1968 | Japan | 264/177.13 |
| 48-2696 | 1/1973 | Japan | 264/147 |
| (11)631566 | 11/1978 | U.S.S.R. . | |
| 631566 | 11/1978 | U.S.S.R. . | |
| 0874771 | 10/1981 | U.S.S.R. | 264/177.13 |
| 874771 | 10/1981 | U.S.S.R. | D01D 5/253 |
| 1153543 | 5/1969 | United Kingdom . | |
| WO 95 01469 | 1/1995 | WIPO . | |

OTHER PUBLICATIONS

Yoshimoto Masato, Production of Animal–Hair Like Yarn, *Patent Abtracts of Japan*, vol. 008, No. 024, Feb. 2, 1984, & JP 58 191212 A (Teijin KK), Nov. 8, 1983.

Gutmann, Improvement of polyamide yarn properties by processing polyamide blends, *Chemical Fibers International*, 46, 418–420, Dec. 1996.

*Primary Examiner*—James J. Bell
*Attorney, Agent, or Firm*—John E. Griffiths

[57] ABSTRACT

The present invention relates to industrial fibers and products made therefrom and more specifically to industrial polyester fibers and products made therefrom. The fibers comprise a synthetic melt spun polymer having a relative viscosity about 24 to about 42, a denier of about 4 to about 8, a tenacity of about 6.5 grams/denier to about 9.2 grams/denier, and a sinusoidal shaped cross section normal to a longitudinal axis of the filament, the cross section having an aspect ratio of about 2 to about 6.

13 Claims, 6 Drawing Sheets

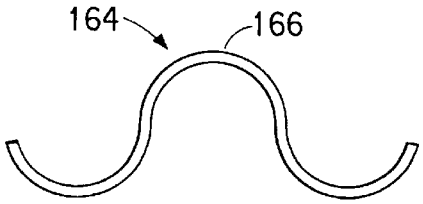
FIG.9A
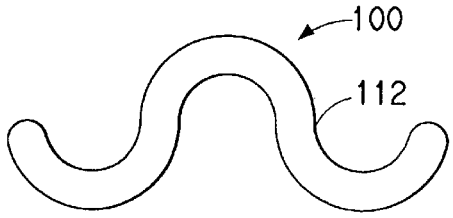
FIG.9B
FIG.10
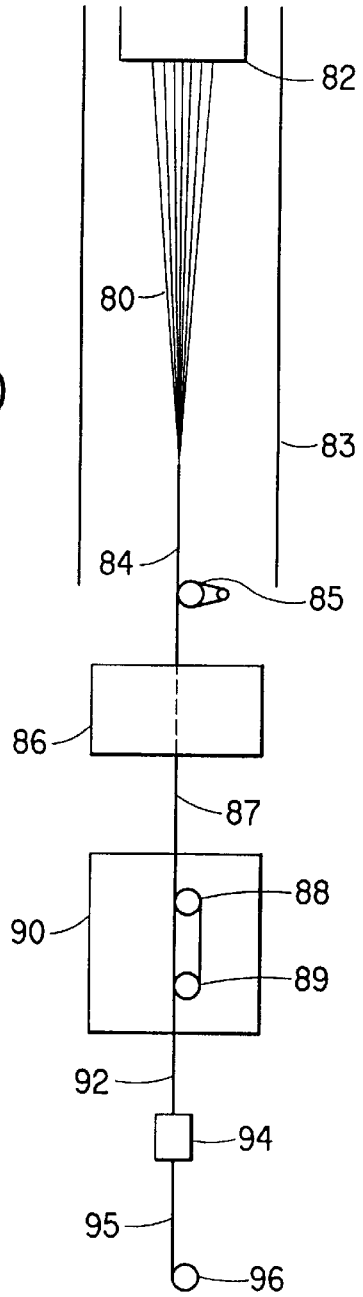

INDUSTRIAL FIBERS WITH SINUSOIDAL CROSS SECTIONS AND PRODUCTS MADE THEREFROM

BACKGROUND OF THE INVENTION

1. Field of the Invention

This invention relates to industrial fibers and products made therefrom and more specifically to industrial polyester fibers and products made therefrom.

2. Description of Related Art

Industrial (i.e., high strength) fibers and multifilament yarns are well-known, including yarns comprising polyester. Such yarns have been manufactured and used commercially for more than 30 years.

Industrial polyester fibers are typically made from poly (ethylene terephthalate) polymer having a relative viscosity of about 24 to about 42, a denier per filament (dpf) of about 4 to about 8, and a tenacity of about 6.5 grams/denier to about 9.2 grams/denier. These characteristics of relative viscosity, denier and tenacity distinguish, in part, yarns described as having "industrial properties" from polyester apparel yarns of lower relative viscosity and lower denier and consequently of significantly lower strength (i.e., tenacity). Industrial polyester yarns having these properties, and processes for producing the yarns, are disclosed in U.S. Pat. No. 3,216,187 to Chantry et al.

It is also known to prepare industrial polyester yarns of varied shrinkage by a continuous process involving spinning, hot-drawing, heat-relaxing, interlacing and winding the yarn to form a package in a coupled process. U.S. Pat. No. 4,003,974 to Chantry et al. disclose such a coupled continuous process for making polyethylene terephthalate multifilament yarns having a maximum dry heat shrinkage of 4% and an elongation to break in the range of 12% to 20%. Combined with the relative viscosity, denier range and tenacity cited above, these shrinkage and elongation to break properties comprise the distinguishing features of yarns with "industrial properties".

U.S. Pat. No. 4,622,187 to Palmer discloses a continuous coupled-process for making polyester yarns of very low shrinkage of about 2%, with other properties suitable for industrial multifilament yarn applications.

Each of the Patents cited above disclose filaments, or multifilament yarns made of filaments, having circular cross-sections normal to their longitudinal axes. For use in apparel applications, it has been proposed to use fibers having non circular cross sections with lower strength than needed for industrial applications. However, to date, all commercial industrial fibers have circular cross sections. In fact, the inventors know of no prior art disclosing an industrial polyester multifilament yarn having a multifilament yarn denier range of about 600 to about 2000 with filaments other than round cross-section.

It is an object of this invention to provide industrial fibers, multifilament industrial yarns and fabrics with improved cover power which reduce the weight of a fabric made from the yarns per unit area without significantly reducing the industrial properties thereof.

These and other objects of the invention will be clear from the following description.

SUMMARY OF THE INVENTION

The invention relates to an industrial filament, comprising a synthetic melt spun polymer having a relative viscosity of about 24 to about 42, a denier of about 4 to about 8, a tenacity of about 6.5 grams/denier to about 9.2 grams/denier, and a sinusoidal shaped cross section normal to a longitudinal axis of the filament, the cross section having an aspect ratio of about 2 to about 6.

The invention is further directed to industrial multifilament yarns, fabrics and other products employing industrial filaments as described herein.

BRIEF DESCRIPTION OF THE DRAWINGS

The invention can be more fully understood from the following detailed description thereof in connection with accompanying drawings described as follows.

FIGS. 9A and 9B illustrate an extended sinusoidal shaped spinneret orifice and an extended sinusoidal shaped cross section of a filament formed by spinning polymer through the extended sinusoidal shaped spinneret orifice.

FIG. 10 is a schematic illustration of a spinning machine for producing yarns comprising the filaments shown in FIG. 1.

DESCRIPTION OF THE PREFERRED EMBODIMENT(S)

Figure 1:
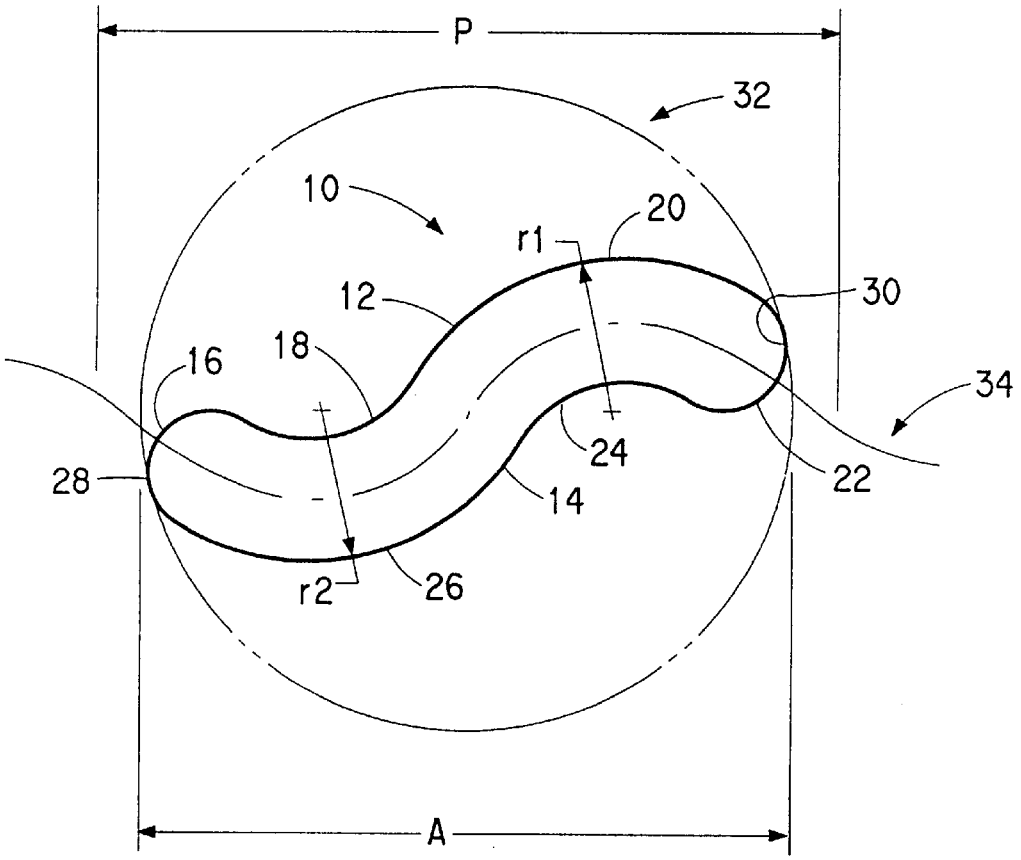
FIG. 1 is a schematic enlarged view, illustrating various measurement parameters, of an industrial filament cut normal to its longitudinal axis showing a sinusoidal shaped cross section in accordance with the invention.

Throughout the following detailed description, similar reference characters refer to similar elements in all figures of the drawings.

The present invention is directed to an industrial filament 10 having a sinusoidal or "S" shaped cross section 12 and products made therefrom including multifilament yarns and fabrics.

1. Filaments

For purposes herein, the term "filament" is defined as a relatively flexible, macroscopically homogeneous body having a high ratio of length to cross-sectional maximum width. Herein, the term "fiber" shall be used interchangeably with the term "filament".

A. Cross Section

Referring to FIG. 1, there is illustrated the industrial filament 10 cut normal to its longitudinal axis showing its sinusoidal shaped cross section 12 in accordance with the invention. The sinusoidal cross section 12 has a periphery 14 comprising, in a clockwise direction in FIG. 1, a first convex end 16, a first concave edge 18, a first convex edge 20, a second convex end 22, a second concave edge 24, and a second convex edge 26. The first convex edge 20 is defined by or substantially by a radius r1. Although not required, it is preferred that the second concave edge 24 is also defined by or substantially defined by the radius r1. The second convex edge is defined by or substantially by a radius r2. Although not required, it is preferred that the first concave edge 18 is also defined by or substantially defined by the radius r2. The radius r1 can be different than the radius r2, but preferably r1 is equal to or substantially equal to r2. The first and second convex ends 16,22 are on distal sides of the periphery 14.

The cross-sectional shape of the filament 10 can be quantitatively described by its aspect ratio (A/B). The term "aspect ratio" has been given various definitions in the past. Herein, when applied to cross sections of filaments, the term "aspect ratio" is defined as a ratio of a first dimension (A) to a second dimension (B). The first dimension (A) is defined as a length of a straight line segment connecting a first point 28 and a second point 30 in the periphery 14 of the filament cross section 12 that are farthest from one another. The first dimension (A) can also be defined as the diameter of a smallest circle 32 that will enclose the cross section 12 of the filament 10. The second dimension B is 2r where r is the sum of the radius r1 of the first outer convex edge 20 and the radius r2 of the second outer convex edge 26. In the sinusoidal cross section 12, neither the first dimension (A) nor the second dimension (B) extend entirely within the cross section 12 of the filament 10. The aspect ratio of the sinusoidal cross section 12 of the present invention is about 2 to about 6, and preferably about 2.5 to about 5.

In a preferred embodiment illustrated in FIG. 1, a portion of a sinusoidal line 34 bisecting the cross section 12 with end points positioned on the first and second convex ends 16,22 of the cross section 12 is less than one complete cycle or period P of the sinusoidal line 34. However, industrial filaments with cross sections extending along a full cycle or more of the sinusoidal line 34 are within the scope of this invention. FIG. 9B illustrates such a filament 100. Further, preferably, each one of the first outer convex edge 20 and the second outer convex edge 26 are less than a half cycle of the sinusoidal line 34.

Preferably, the cross sections 12 consist of entirely curved or arcuate, and no straight, edges or surfaces.

B. Polymers

The filaments 10,100 can be made from any and all types of synthetic polymers and mixtures thereof which are capable of being melt spun into filaments having industrial properties as specified herein. Preferably, the polymers are polyesters or polyamides.

Polyester polymer is used in this application to refer to polyester homopolymers and copolymers which are composed of at least 85% by weight of an ester of a dihydric alcohol and terephthalic acid. Some useful examples of polyesters and copolyesters are shown in U.S. Pat. Nos. 2,071,251 (to Carothers), 2,465,319 (to Whinfield and Dickson), 4,025,592 (to Bosley and Duncan), and 4,945,151 (to Goodley and Taylor). Most preferably, the polyester polymer used to make the filaments should be essentially 2G-T homopolymer, i.e., poly(ethylene terephthalate).

Nylon polymer is used in this application to refer to polyamide homopolymers and copolymers which are predominantly aliphatic, i.e., less than 85% of the amide-linkages of the polymer are attached to two aromatic rings. Widely-used nylon polymers such as poly(hexamethylene adipamide) which is nylon 6,6 and poly(e-caproamide) which is nylon 6 and their copolymers can be used in accordance with the invention. Other nylon polymers which may be advantageously used are nylon 12, nylon 4,6, nylon 6,10 and nylon 6,12. Illustrative of polyamides and copolyamides which can be employed in the process of this invention are those described in U.S. Pat. Nos. 5,077,124, 5,106,946, and 5,139,729 (each to Cofer et al.) and the polyamide polymer blends disclosed by Gutmann in Chemical Fibers International, pages 418–420, Volume 46, December 1996.

The polymers and resulting filaments 10,100, yarns and fabrics may contain the usual minor amounts of such additives as are known in the art, such as delustrants or pigments, light stabilizers, heat and oxidation stabilizers, additives for reducing static, additives for modifying dye ability, etc. Also as known in the art, the polymers must be of filament-forming molecular weight in order to melt spin into yarn.

C. Relative Viscosity

Polymers having relative viscosity of about 24 to about 42, preferably about 36 to about 38, have been found to give very good results as indicated hereinafter in the Examples.

D. Denier

The filaments 10,100 of the present invention have a denier per filament (dpf) of about 4 to about 8 (about 4.4 dtex to about 8.9 dtex), and preferably about 6 to about 7.2 (about 6.6 dtex to about 8.0 dtex). These deniers are preferably measured deniers as described herein. Preferably, the measured deniers are "as spun" measured average deniers which includes yarn finish and ambient moisture as described herein.

E. Tenacity

The filaments 10,100 of the present invention have a tenacity of about 6.5 grams/denier to about 9.2 grams/denier, and preferably a tenacity of about 7.5 grams/denier to about 8.0 grams/denier.

F. Other Properties

The filaments 10,100 of the present invention have a dry heat shrinkage of about 2% to about 16% at 30 minutes at 177° C., and preferably a dry heat shrinkage of about 3% to about 13% at 30 minutes at 177° C.

The filaments 10,100 of the present invention have an elongation to break in the range of 16% to 29%, and preferably of 17% to 28%.

2. Yarns

A yarn comprises a plurality (typically 140–192) of the industrial filaments 10,100 having a degree of cohesion. The filaments 10,100 in a yarn are preferably intermingled and tangled through an intermingling device or otherwise. A typical intermingling device and process is disclosed in U.S. Pat. No. 2,985,995 and is suitable for use in the manufacture of the instant yarns. During the spinning process, the filaments 10,100 with a sinusoidal cross section 12,112 have a tendency to naturally intermingle without the aid of an intermingling device. The term "yarn" as used herein includes continuous filaments and staple filaments, but are preferably continuous filaments. The filaments 10,100 are "continuous" meaning that the length of the filaments 10,100 making up the yarn are the same length as the yarn and are substantially the same length as other filaments in the yarn, in contrast to filaments in a yarn that are discontinuous which are often referred to as staple filaments or cut filaments formed into longer yarns much the same way that natural (cotton or wool) filaments are.

Due to the unique sinusoidal cross section 12 of the filaments 10, some of the filaments 10 in a yarn typically position themselves in a first tile arrangement and some position themselves in a second tile arrangement. In the first tile arrangement illustrated in FIG. 2, the filaments 10 are positioned such that the ends 22 of a first set 36 of the filaments 10 are near, and aligned with, the ends 16 of a second set 38 of the filaments 10 such that pairs of the first set 36 of the filaments 10 and the second set 38 of the filaments 10 are positioned substantially along nonoverlapping sinusoidal lines 40. This first tile arrangement provides a very dense arrangement with minimum voids 42 between filaments 10. In the second tile arrangement illustrated in FIG. 3, the filaments 10 are positioned such that inner concave surfaces 24 of a first set 44 of the filaments 10 contact inner concave surfaces 18 of a second set 46 of the filaments 10, outer convex surfaces 20 of the first set 44 of the filaments 10 contact outer convex surfaces 26 of the second set 46 of the filaments 10, such that the first set 44 of the filaments 10 and the second set 46 of the filaments 10 are positioned in a locked arrangement. The second tile arrangement provides a natural cohesion between the filaments 10.

Figure 2:
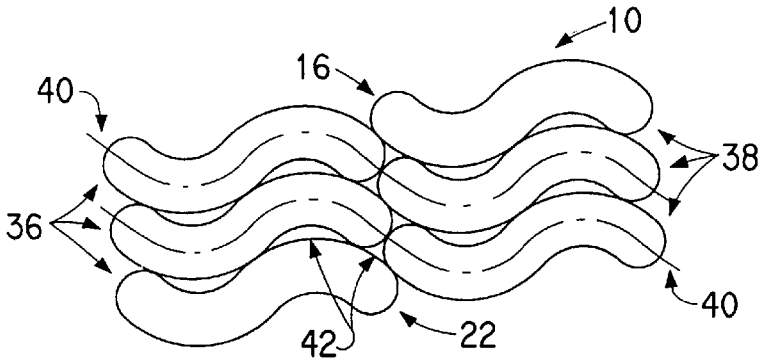
FIG. 2 is a schematic enlarged view of a first tile arrangement of the filaments shown in FIG. 1 in an industrial yarn cut normal to its longitudinal axis.
Figure 3:
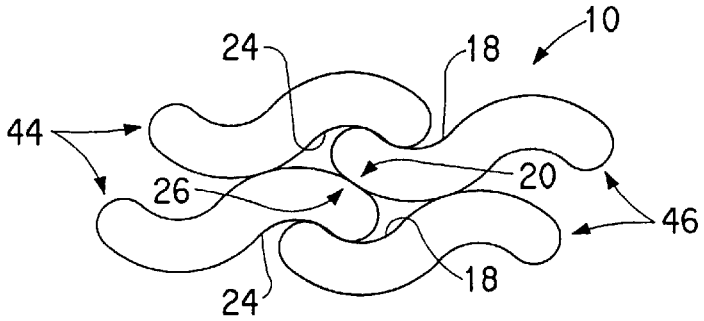
FIG. 3 is a schematic enlarged view of a second tile arrangement of the filaments shown in FIG. 1 in an industrial yarn cut normal to its longitudinal axis.
Figure 4:
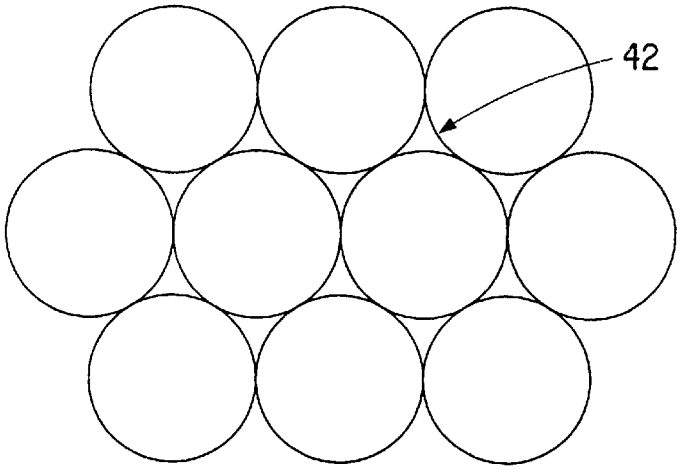
FIG.4 (PRIOR ART)
FIG. 4 is a schematic enlarged view of a prior art arrangement of filaments having round cross sectional shapes in an industrial yarn cut normal to its longitudinal axis.

As can be seen comparing the first tile arrangement illustrated in FIG. 2 to the most compact arrangement of prior art industrial round cross section filaments illustrated in FIG. 4 which have substantially the same cross sectional area as those in FIG. 2, the first tile arrangement of the filaments 10 with the sinusoidal cross sections are more dense (i.e., have smaller void areas 42). Further, comparing the first tile arrangement in FIG. 2 and the second tile arrangement in FIG. 3 to the prior art arrangement in FIG. 4, one can see that the tile arrangements of FIGS. 2 and 3 provide a greater covering power than the arrangement of the filaments with round cross sections in FIG. 4. The term "covering power" means that the same volume or weight of filaments 10 with the sinusoidal cross sections covers or extends over a larger surface (left to right in FIGS. 2–4) than an arrangement of the same number of filaments with round cross sections having areas the same or substantially the same as the areas of the sinusoidal cross sections. Thus, the elongated shape the filaments 10 with sinusoidal cross sections 12 give a bundle of the filaments 10 a tendency to spread out along a surface increasing the covering power or property when used, instead of filaments with round cross sections of similar construction and weight and having the same or substantially the same cross sectional area per filament.

Figure 5:
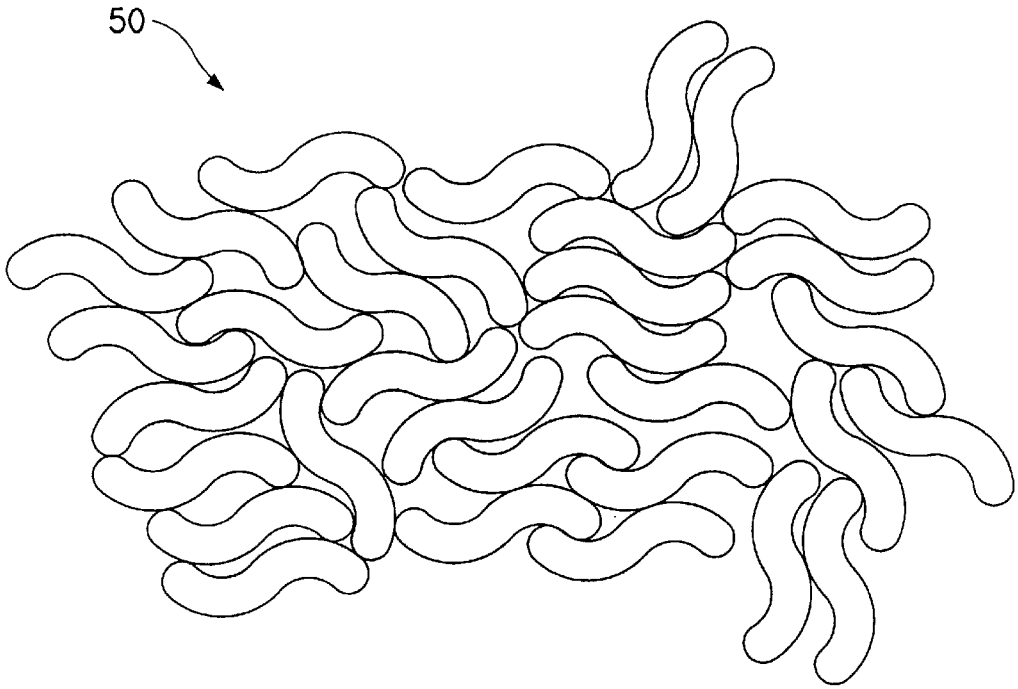
FIG. 5 is a schematic enlarged view of an industrial yarn cut normal to its longitudinal axis in accordance with the present invention.

FIG. 5 is a schematic enlarged view of a portion of an industrial yarn 50 cut normal to its longitudinal axis in accordance with the present invention. The tile arrangements illustrated in FIGS. 2 and 3 can be seen throughout the yarn cross section in FIG. 5.

3. Fabric The invention is further directed to industrial fabric 52 that includes at least one of the industrial yarns with at least some of the industrial filaments 10 in accordance with the invention. The filaments 10 produced in accordance with the present invention may be employed as yarns and converted, e.g., by weaving into fabric patterns of any conventional design by known methods. Furthermore, these bodies may be combined with other known filaments to produce mixed yarns and fabrics. Fabrics woven or knitted from, the filaments 10 produced in accord with this invention have increased covering power and reduced weight as compared to fabrics of similar construction and weight made from round filaments having the same cross sectional area per filament.

Figure 6:
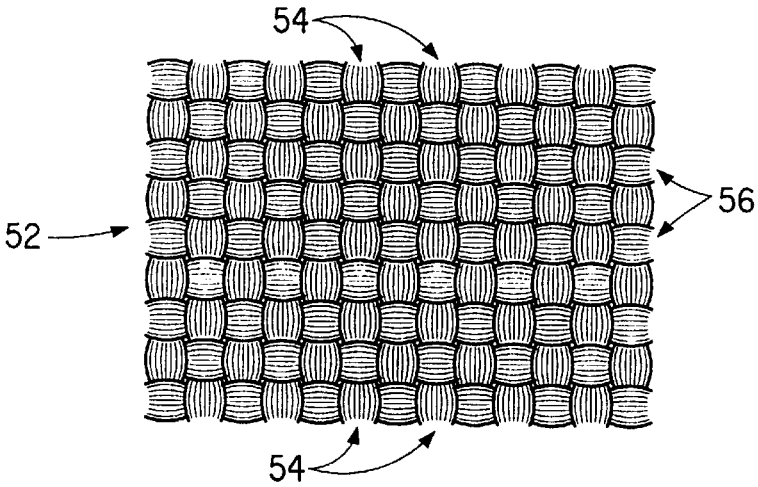
FIG. 6 is a schematic enlarged view of one embodiment of a fabric in accordance with the present invention.

In one embodiment illustrated in FIG. 6, the woven industrial fabric 52 comprises a plurality of first industrial yarns 54 in a warp direction, a plurality of second industrial yarns 56 in a fill direction weaved with the first industrial yarns 54, and at least some of the first industrial yarns 54 and/or at least some of the second industrial yarns 56 comprising a plurality of the industrial filaments 10. Preferably, at least the first industrial yarns 54 or the second industrial yarns 56 comprise a plurality of the industrial filaments 10. In this preferred case, the fabric 52 can have a reduction in total weight by at least 7% compared to a fabric made entirely from yarns comprising other filaments which are essentially the same as the industrial filaments, except the other filaments having circular cross sections. A range for fabric weight reduction (compared to a fabric made entirely from yarns comprising other filaments which are essentially the same as the industrial filaments 10, except the other filaments having circular cross sections) is from about 5% to about 15%.

In a second embodiment, the woven industrial fabric 52 comprises a plurality of first industrial yarns 54 in a warp direction, a plurality of second industrial yarns 56 in a fill direction weaved with the first industrial yarns 54, and at least some of the first industrial yarns 54 and at least some of the second industrial yarns 56 comprising a plurality of the industrial filaments 10. In this case, the fabric 52 can have a reduction in total weight by at least 10% compared to a fabric entirely made from yarns comprising other filaments which are essentially the same as the industrial filaments 10, except the other filaments having circular cross sections. In this case, a range for fabric weight reduction using yarns made entirely of the filaments 10 is from about 10% to about 30%.

4. Spinnerets

Figure 7:
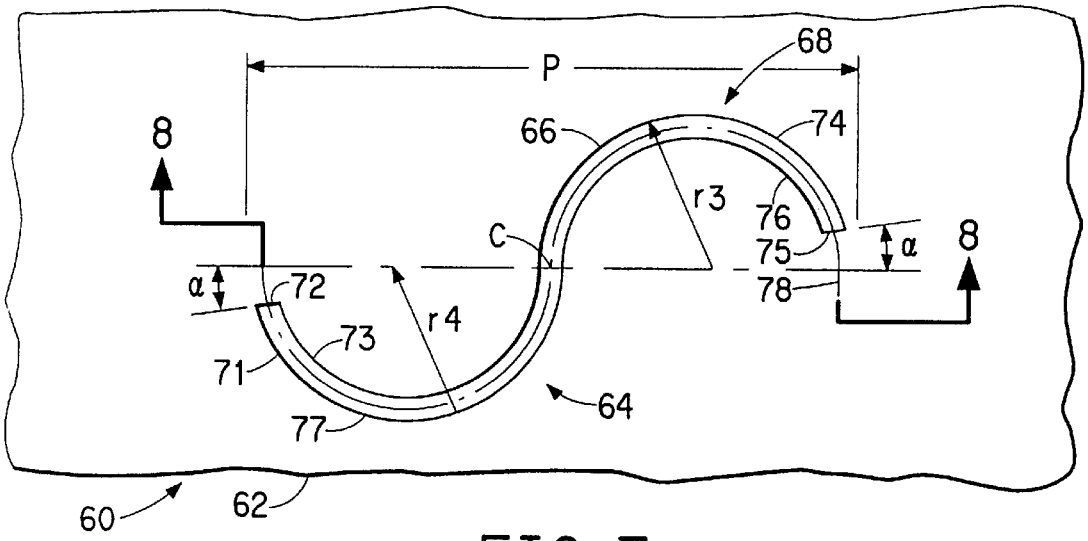
FIG. 7 is a view of a spinneret orifice in a spinneret for spinning the filaments shown in FIG. 1.
Figure 8:
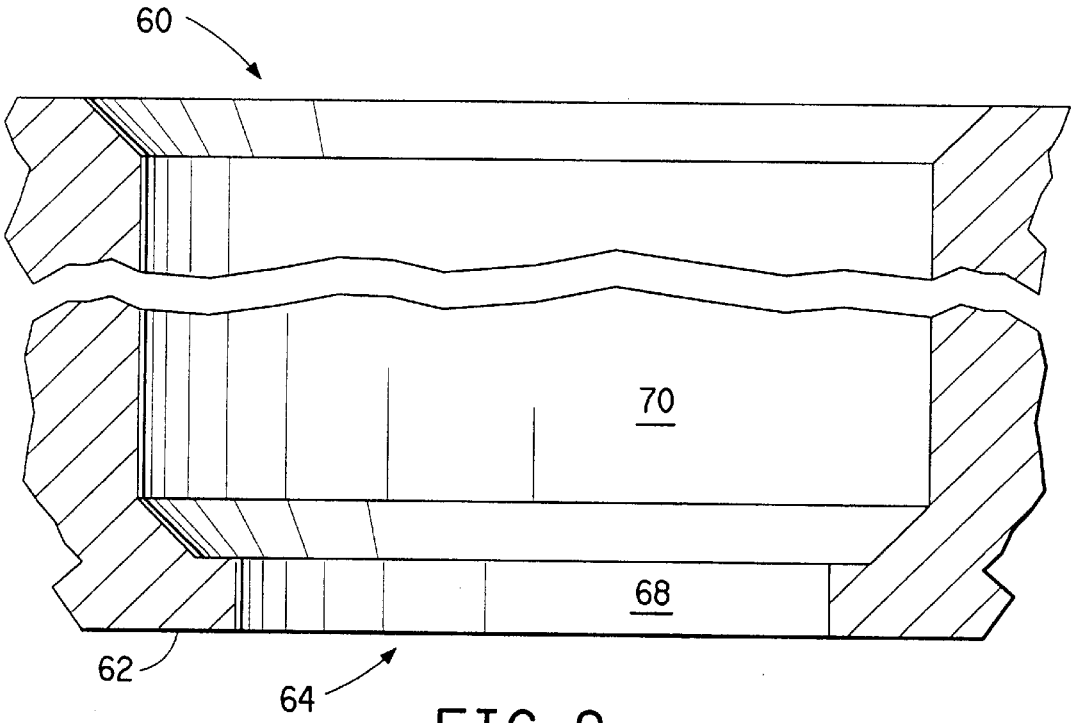
FIG. 8 is a cross sectional view generally along line 8—8 of the spinneret shown in FIG. 7 in the direction of the arrows.

FIGS. 7 and 8 illustrate a spinneret 60 for use in the melt extrusion of a synthetic polymer to produce the industrial filaments 10 having sinusoidal cross sections 12 in accordance with the present invention. The spinneret 60 comprises a plate 62 having an assembly of orifices, capillaries or holes 64 through which molten polymer is extruded to form the industrial filaments 10. FIG. 7 shows a bottom view of one of the orifices, capillaries or holes 64 having a sinusoidal shape or cross section 66 through the plate 62. In FIG. 7, the sinusoidal cross section 66 is normal to a longitudinal axis passing normal through the sheet of drawings through center point c of the orifices, capillaries or holes 64. FIG. 8 is a cross sectional view generally along line 8—8 of the spinneret 60 shown in FIG. 7 in the direction of the arrows. As illustrated in FIG. 8, each hole 64 has two sections: a capillary 68 itself and a much larger and deeper counter bore passage 70 connected to the capillary 68.

The sinusoidal cross section 66 of the capillary 68 has a periphery 71 comprising, in a clockwise direction in FIG. 7 and joined to one another, a first straight or substantially straight end 72, a first concave edge 73, a first convex edge 74, a second straight or substantially straight end 75, a second concave edge 76, and a second convex edge 77 joined to the first end 72. The first convex edge 74 is defined by or substantially defined by a radius r3. Although not required, it is preferred that the second concave edge 76 is also defined by or substantially defined by the radius r3. The second convex edge 77 is defined by or substantially defined by a radius r4. Although not required, it is preferred that the first concave edge 73 is also defined by or substantially defined by the radius r4. The radius r3 can be different than the radius r4, but preferably r3 is equal to or substantially equal to r4. Further, it is within the scope of this invention that r1, r2, r3, r4 can be all different lengths, all the same lengths or any mix of lengths.

The cross-sectional shape 66 of the capillary 68 can also be quantitatively described by its aspect ratio (A/B). Herein, when applied to cross sections of capillaries, the term "aspect ratio" is defined as a ratio of a first dimension (A) to a second dimension (B). The first dimension (A) is defined as a length of a straight line segment connecting a first point and a second point in the periphery 71 of the capillary cross section 66 that are farthest from one another. The first dimension (A) can also be defined as the diameter of a smallest circle that will enclose the cross section 66 of the capillary 68. The second dimension B is 2r where r is the sum of the radius r3 of the first outer convex edge 74 and the radius r4 of the second outer convex edge 77. In the capillary sinusoidal cross section 66, neither the first dimension (A) nor the second dimension (B) extend entirely within the cross section 66 of the capillary 68. The aspect ratio of the sinusoidal cross section 66 of the capillaries 68 of the present invention is about 1.3 to about 6, and preferably about 1.5 to about 2.5.

In a preferred embodiment illustrated in FIG. 7, a portion of a sinusoidal line 78 bisecting the cross section 66 with end points positioned on the first and second ends 72,75 of the capillary cross section 66 is less than one complete cycle or period P of the sinusoidal line 78. However, capillary cross sections 66 extending along a full cycle or more of the sinusoidal line 78 are within the scope of this invention. FIG. 9A illustrates such a capillary 164. Further, preferably, each one of the first outer convex edge 74 and the second outer convex edge 77 are less than a half cycle of the sinusoidal line 78. This reduces the chances of the ends 22,28 joining with another point of the filament cross section 12 during the spinning process thereby reducing the chance that a filament cross section 12 will form with two holes, as illustrated in FIG. 11B, or one hole at one end.

The spinneret 60 used in the production of filaments 10 of the present invention may be of any conventional material employed in spinneret construction for melt-spinning. The stainless steels are especially suitable.

Each spinneret 60 may have from one to several thousand individual holes 64. The hole layout, or array, is carefully designed to keep filaments 10 properly separated, to permit each filament 10 the maximum unobstructed exposure to quench air, and to assure that all filaments 10 are treated as nearly equal as possible.

The counter bore 70 can have a round cross section and can be formed by drilling. However, the capillaries 68 must be fabricated to precise dimensions such as with laser capillary machine.

The shape of the spinneret capillary 68 determines the shape of the spun filament 10. The size of the individual filament 10 is controlled by the size of the capillary 68, the metering rate and the speed at which the filaments 10 are withdrawn from the quench zone and typically fixed by the rotational speed of the feed roll assembly, and not by capillary design alone. As such, the cross section 12 of the filaments 10 are smaller than the actual size of the capillary 68 through which they are produced.

FIGS. 9A and 9B illustrate an extended sinusoidal shaped spinneret capillary 166 and an extended sinusoidal shaped cross section 112 of a filament 100 in accordance with this invention formed by spinning polymer through the extended sinusoidal shaped spinneret capillary 166.

INDUSTRIAL APPLICABILITY

The filaments, yarns and fabrics of the present invention have market uses that include automobile airbags, industrial fabrics (architectural fabrics, signage, tarps, tents, etc.) sailcloth, tire cord, cordage (ropes), webbing, leisure fabrics, mechanical rubber goods, and others.

TEST METHODS

Temperature: All temperatures are measured in degrees Celsius (°C).

Relative Viscosity: Any relative viscosity (RV) measurement referred to herein is the unitless ratio of the viscosity of a 4.47 weight on weight percent solution of the polymer in hexafluoroisopropanol containing 100 ppm sulfuric acid to the viscosity of the solvent at 25° C. Using this solvent, the industrial yarns in the prior art, such as U.S. Pat. No. 3,216,817, have relative viscosities of at least 35.

Denier: All parts and percentages are by weight unless otherwise indicated.

Denier is linear density and defined to be the number of unit weights of 0.05 gram per 450 meters (Man-Made Fiber and Textile Dictionary, Hoechst-Celanese, 1988). This definition is numerically equivalent to weight in grams per 9000 meters of the material. Another definition of linear density is Tex, the weight in grams of 1000 meters of material. The deciTex (dTex) is also widely used, equal to 1/10 of 1 Tex.

All yarn deniers reported herein are nominal deniers unless otherwise indicated as measured. As used herein, "nominal" denier means the intended numerical value of denier.

As used herein, "measured" denier is by the method of cutting a standard length of yarn and weighing. The industrial polyester yarns, reported herein, had their yarn deniers determined by an E. I. du Pont de Nemours and Company (Wilmington, Del.) designed automatic cut and weigh (ACW) deniering instrument. This ACW instrument is commercially available from LENZING AG, Division Lenzing Technik, A-4860 Lenzing, Austria. Measured denier was by the ACW instrument method and based on 2 observations per yarn package. These two observations were averaged. Thus, the "measured" denier is an average denier. The yarn test specimen length was 22.5 meters and the specimen length tolerance was +/−1.0 cm. All ACW machine weights were within +/−0.2 milligram tolerance of certified standards used in machine calibration. The calculations for denier were based on the equation:

$$D=(9000\text{ meter}\times W(\text{grams})/22.5\text{ meters}$$

where D=denier; and W=specimen weight.

For example, a 22.5 meter length of yarn from a sample of 840 nominal denier yarn was cut and weighed by the ACW machine. This 22.5 meter sample should have a measured weight of 2.10 grams for the nominal and measured yarn denier to be identical at 840 denier (or 933.3 deciTex). Similarly, the 1000 nominal denier yarns (or 1111 dTex) reported herein should have a weight of 2.50 grams for the nominal and measured yarn denier to be identical and the 1100 nominal denier yarns (or 1222 dTex) have a weight of 2.75 grams per 22.5 meters for the nominal and measured yarn denier to be identical.

The "measured" yarn denier has been reported in the prior art in two ways. The first way is "as spun" measured denier which includes yarn finish and ambient moisture. Typically, our "nominal" 840 yarn denier is 847 measured denier "as spun". The second way "measured" yarn denier is reported is "measured" yarn denier "as sold". The term "as sold" does not mean the filaments were, in fact, sold or offered for sale. Instead, it means the yarn is prepared as if it was going to be sold prior to denier measurement. Prior to "as sold" denier measurement, the yarn finish is scoured off and the yarn standard moisture content is equilibrated at 0.4%. The "as sold" measured yarn denier is, by definition, equal to nominal denier or 840 in this case. All "measured" yarn denier reported herein is "as spun", meaning the weight of yarn finish and ambient moisture is included in the calculation.

Tensile Properties: The tensile properties for the yarns reported herein are measured on an Instron Tensile Testing Machine (Type TTARB). The Instron extends a specified length of untwisted yarn to its breaking point at a given extension rate. Prior to tensile testing, all yarns are conditioned at 21.1 degrees C. and 65% relative humidity for 24 hours. Yarn "extension" and "breaking load" are automatically recorded on a stress-strain trace. For all yarn tensile tests herein, the sample length was 10 inches (25 cm), the extension rate was 12 inches/minute (30 cm) or 120%/minute, and the stress-strain chart speed was 12 inches/minute (30 cm/minute).

Tenacity: Yarn "tenacity" (T) was derived from the yarn breaking load. Tenacity (T) was measured using the Instron Tensile Tester Model 1122 which extends a 10-inch (25 cm) long yarn sample to its breaking point at an extension rate of 12 inch/min (30 cm/min) at a temperature of about 25° C. Extension and breaking load are automatically recorded on a stress-strain trace by the Instron. Tenacity is numerically defined by the breaking load in grams divided by the original yarn sample measured denier.

Dry Heat Shrinkage: Dry Heat Shrinkages (DHS) are determined by exposing a measured length of yarn under zero tension to dry heat for 30 minutes in an oven maintained at the indicated temperatures (177 degrees C. for DHS177 and 140 degrees C. for DHS140) and by measuring the change in length. The shrinkages are expressed as percentages of the original length. DHS177 is most frequently measured for industrial yarns, we find DHS140 to give a better indication of the shrinkage that industrial yarns actually undergo during commercial coating operations, although the precise conditions vary according to proprietary processes.

EXAMPLES

This invention will now be illustrated by the following specific examples.

Comparative Example A

Industrial polyester filaments with round or circular cross sections were produced in accordance with the process disclosed in U.S. Pat. No. 4,622,187 to Palmer. More specifically, and referring to FIG. 10, polyester filaments 80 were melt-spun from a spinneret 82, and solidified as they passed down within chimney 83 to become an undrawn multifilament yarn 84, which was advanced to the drawing stage by feed roll 85, the speed of which determined the spinning speed, i.e., the speed at which the solid filaments are withdrawn in the spinning step. The undrawn yarn 84 was advanced past heater 86, to become drawn yarn 87, by draw rolls 88 and 89, which rotated at the same speed, being higher than that of feed roll 85. The draw ratio is the ratio of the speed of draw rolls 88 and 89 to that of feed roll 85, and was generally between 4.7X and 6.4X. The drawn yarn 87 was annealed as it made multiple passes between draw rolls 88 and 9 within heated enclosure 90. The resulting yarn 92 was interlaced to provide coherency as it passed through interlacing jet 94. Interlace jet 94 provided heated air so that the interlaced yarn 95 was maintained at an elevated temperature as it was advanced to wind-up roll 96 where it was wound to form a yarn package. The interlaced yarn 95 was relaxed because it was overfed to wind-up roll 96, i.e., the speed of wind-up roll 96 was less than that of rolls 89 and 88. Finish was applied in conventional manner, not shown, generally being applied to undrawn yarn 84 before feed roll 85 and to drawn yarn 87 between heater 86 and heated enclosure 90.

The draw roll speed was 3100 ypm (2835 meters/min). The properties were measured as described hereinafter. The process was followed using a steam jet at 360° C. for the heater 86, and a draw ratio of 5.9X between draw roll 88 and feed roll 85, heating rolls 88 and 89 to 240° C. within enclosure 90, overfeeding the yarn 13.5% between roll 89 and wind-up roll 96, so that the wind-up speed was 2680 ypm (about 2450 meters/min), and using interlacing air at 45 pounds per square inch (psi) and at 160° C. in jet 94.

A yarn of 840 nominal denier, 140 filaments and 37 relative viscosity was made using the process and apparatus described above. The yarn was made of filaments with round or circular cross-sections. The filaments were spun from polyester polymer (2GT) having 0.10% titanium dioxide as a delusterant, residual antimony catalyst at a level in the range of 300 to 400 parts per million, and small amounts of phosphorus in a range of 8 to 10 parts per million. The only other intentionally provided additive was a "toner", which was an anthraquinone dye, at level of 1 to 5 parts per million.

Figure 14A:
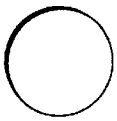
FIG. 14A (PRIOR ART)
FIGS. 14A and 14B illustrate a circular shaped spinneret orifice and a circular cross section of a filament formed by spinning polymer through the circular shaped spinneret orifice.
Figure 14B:
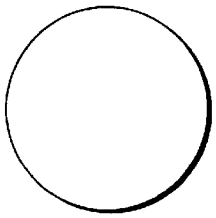
FIG. 14B (PRIOR ART)

The round cross-section yarn so produced had a good balance of shrinkage and tensile properties. The produced yarn had a measured "as spun" average denier of 847. The measured denier range was from 823 to 873. The yarn had a tenacity of 7.9 grams per denier and an elongation at break equal to 28%. The shrinkage (DHS177) of the yarn was 3.1%. The properties of this Comparative Example A yarn are summarized in Table 1. This Comparative Example shows the properties of a typical prior art Dacron® industrial yarn (with round filament cross sections as illustrated in FIG. 14B) sold by DuPont under designation 840-140-T51 and is a low shrinkage yarn. This prior art yarn packs together as the filament bundle illustrated by FIG. 4.

Comparative Example B

Using exactly the same conditions as in Comparative Example A, except for a spinneret was used with an enlarged capillary dimension versus that capillary dimension used in Example 1, yarns of 1000 nominal denier were produced having 140 filaments with round cross sections as shown in FIG. 14B. The same shrinkage and tensile properties as for Comparative Example A yarns were measured. The properties of this Comparative Example B yarn are summarized in Table 1. This Comparative Example B shows the properties of a typical prior art Dacron® industrial yarn sold by DuPont under designation 1000-140-T51, a low shrinkage yarn.

Comparative Example C

Using exactly the same conditions as in Comparative Example A, except as note herein, yarns of 1000 nominal denier were produced having 192 filaments with round cross sections as shown in FIG. 14B. In contrast to Comparative Examples A and B, the spinneret used had reduced capillary dimensions. The shrinkage and tensile properties were different from those properties of Comparative Example A yarns by means of altered process conditions: the overfeed speed between roll 9 and wind-up roll 14 was reduced to 5%, so that the wind-up roll speed was 2945 yards per minute (2693 meters/min.) and the interlace air temperature was at room temperature (ca. 30 degrees C.) and slightly higher delivery pressure, 50 pounds per square inch. These yarns had a tenacity of 8.9 grams per denier, an elongation at break of 17.5% and a dry heat shrinkage (DHS177) of 12.2%. The properties of this Comparative Example B yarn are summarized in Table 1. This Comparative Example B shows the properties of a typical prior art Dacron® industrial yarn sold by DuPont under designation 1000-192-T68, a high shrinkage yarn.

Comparative Example D

Figure 13A:
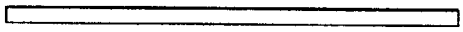
FIGS. 13A and 13B illustrate a flat ribbon shaped spinneret orifice and a flat ribbon cross section of a filament formed by spinning polymer through the flat ribbon shaped spinneret orifice.
Figure 13B:
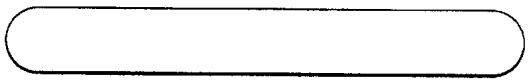

Using exactly the same conditions as in Comparative Example A, except as noted herein, yarns of 1100 nominal denier were produced having 140 filaments. The filaments were produced from spinnerets with capillary shapes as shown in FIG. 13A and resulted in filaments with flat ribbon shaped cross sections as shown in FIG. 13B. These yarns had dry-heat shrinkage properties which measured the same as in Comparative Example A. The properties of this Comparative Example D yarn are summarized in Table 1.

Comparative Example E

Using exactly the same conditions as in Comparative Example D, except as noted herein, yarns of 1000 nominal denier were produced having 140 filaments from spinnerets with capillary shapes as shown in FIG. 13A and slightly smaller in capillary size than in Comparative Example D. These yarns had filaments with flat ribbon shaped cross sections as shown in FIG. 13B. These yarns had dry-heat shrinkages which were produced according to the method disclosed in Palmer, U.S. Pat. No. 4,622,187, Example 1, Sample A, where an overfeed between roll 9 and wind-up 14 of 9.1% allowed a wind-up speed of 2820 yards per minute (2580 meters/min.) and interlace air at 50 pounds per square inch delivery pressure and about 30 degrees C. provided a dry-heat shrinkage (DHS177) of 5.3% and a tenacity of 8.4 grams per denier. The properties of this Comparative Example E yarn are summarized in Table 1.

Comparative Example F

Figure 11A:
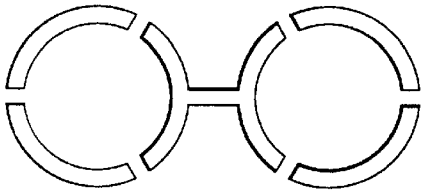
FIGS. 11A and 11B illustrate a hollow bilobal shaped spinneret orifice and a hollow bilobal cross section of a filament formed by spinning polymer through the hollow bilobal shaped spinneret orifice.
Figure 11B:
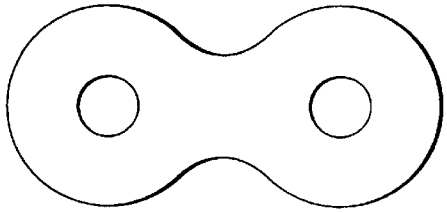

Using exactly the same conditions as in Comparative Example E, except as noted herein, yarns of 1000 nominal denier were produced having 140 filaments from spinnerets with capillary shapes as shown in FIG. 11A. This yarn had filaments with hollow bilobal shaped cross sections as shown in FIG. 11B. The properties of this Comparative Example F yarn are summarized in Table 1.

Comparative Example G

Figure 12A:
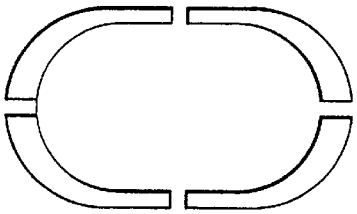
FIGS. 12A and 12B illustrate a hollow oval shaped spinneret orifice and a hollow oval cross section of a filament formed by spinning polymer through the hollow oval shaped spinneret orifice.
Figure 12B:
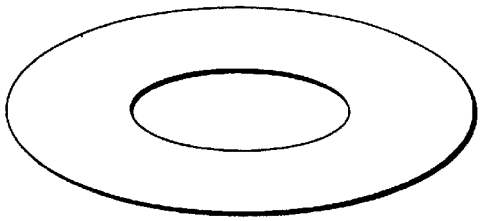

Using exactly the same conditions as in Comparative Example A, except as noted herein, yarns of 1000 nominal denier were produced having 140 filaments from spinnerets with enlarged capillary shapes as shown in FIG. 12A. This yarn had filaments with hollow disc shaped cross sections as shown in FIG. 12B. The properties of this Comparative Example G yarn are summarized in Table 1.

Comparative Example H

Using exactly the same conditions as in Comparative Example C, except as noted herein, a yarn of 840 nominal denier was produced having 140 filaments. The filaments were produced from spinnerets with round capillary shapes as shown in FIG. 14A and resulted in filaments with round shaped cross sections as shown in FIG. 14B. The properties of this Comparative Example H yarn are summarized in Table 1. This Comparative Example shows the properties of a typical prior art Dacron® industrial yarn sold by DuPont under designation 840-140-T68, a high shrinkage yarn.

Comparative Example I

Using exactly the same conditions as in Comparative Example A, except a spinneret was used with an enlarged capillary versus the capillaries used in Comparative Example A yarns of 1100 nominal denier were produced having 140 filaments with round cross sections as shown in FIG. 14B. The same shrinkage properties as for Comparative Example A yarns were measured. The properties of this Comparative Example I yarn are summarized in Table 1. This Comparative Example shows the properties of a typical prior art Dacron® industrial yarn sold by DuPont under designation 1100-140-T51, a low shrinkage yarn.

EXAMPLE 1

Using exactly the same conditions as in Comparative Example A, except as noted herein, yarns of 840 nominal denier were produced having 140 filaments from spinnerets with capillary shapes as shown in FIG. 7. This yarn had filaments with "S"-shaped cross sections as shown in FIG. 1. The properties of this Example 1 yarn are summarized in Table 1.

EXAMPLE 2

Using exactly the same conditions as in Comparative Example A, except as noted herein, yarns of 1000 nominal denier were produced having 140 filaments from spinnerets with enlarged capillary shapes as shown in FIG. 7. This yarn had filaments with "S"-shaped cross sections as shown in FIG. 1. The properties of this Example 2 yarn are summarized in Table 1.

EXAMPLE 3

Using exactly the same conditions as in Comparative Example C, except as noted herein, yarns of 1000 nominal denier and 192 filaments were produced from spinnerets with capillary shapes as shown in FIG. 7. The resulting filaments had "S"-shaped cross sections as shown in FIG. 1. These yarns had dry-heat shrinkage properties which measured the same as in Comparative Example C. The properties of this Example 3 yarn are summarized in Table 1.

TABLE 1

| | YARNS | | | | | | |
|---|---|---|---|---|---|---|---|
| | Nominal Yarn Den. | No. Fil. | Meas. Yarn Den. | Den/ Fil. | (g/Den) Ten. | shrink. % | aspect ratio |
| Comparative Examples | | | | | | | |
| A (FIG. 14B) | 840 | 140 | 848 | 6.0 | 7.9 | 3.1 | 1 |
| B (FIG. 14B) | 1000 | 140 | 1009 | 7.1 | 7.9 | 3.1 | 1 |
| C (FIG. 14B) | 1000 | 192 | 1008 | 5.2 | 8.9 | 12.2 | 1 |
| D (FIG. 13B) | 1100 | 140 | 1110 | 7.9 | 7.9 | 3.1 | 7 |
| E (FIG. 13B) | 1000 | 140 | 1007 | 7.1 | 8.4 | 5.3 | 7 |
| F (FIG. 11B) | 1000 | 140 | 1007 | 7.1 | 8.4 | 5.3 | 2.1 |
| G (FIG. 12B) | 1100 | 140 | 1110 | 7.9 | 7.8 | 3.1 | 1.6 |
| H (FIG. 14B) | 840 | 140 | 847 | 6.0 | 8.9 | 12.2 | 1 |
| I (FIG. 14B) | 1100 | 140 | 1110 | 7.9 | 7.9 | 3.1 | 1 |
| Invention Examples | | | | | | | |
| 1 (FIG. 1) | 840 | 140 | 847 | 7.1 | 7.5 | 2.7 | 3.9 |
| 2 (FIG. 1) | 1000 | 140 | 1009 | 7.1 | 7.5 | 2.7 | 4 |
| 3 (FIG. 1) | 1000 | 192 | 1008 | 5.2 | 8.9 | 12.2 | 4 |

Table 1 summarizes the properties of Comparative Example yarns A through I with the invention Example yarns 1, 2 and 3. The invention yarn properties, particularly those properties consistent with industrial yarn applicability, e.g., tenacity and shrinkage, are shown by way of this Table 1 comparison to be substantially preserved regardless of filament cross sectional shape. The sinusoidal cross-section shaped filaments in the form of industrial polyester yarns are not different or substantially different from the prior art and other comparison yarns with respect to these properties. The surprising and distinguishing features of the inventive yarns are found in the properties of a fabric incorporating yarns with at least some of the sinusoidal cross section shaped filaments.

EXAMPLE 4

A fabric was constructed from the Comparative Example H yarns in the warp direction with 19.5 yarns or picks per inch (ppi) and Example 3 yarns in the fill direction with 21 ppi. The fabric was visually rated for cover creating ability of the fill yarn by an observer using a light box for background illumination of the fabric. A 1–10 rating system was used with a rating of 1 given to the control fabric (Comparative Example O) and higher numbers given to indicate visually better covering power. Properties for and observations on this fabric are summarized in Table 2.

Comparative Example J

A fabric was constructed from the Comparative Example H yarns in the warp direction with 19.5 ppi and Comparative Example D yarns in the fill direction with 21 ppi. The fabric was visually rated for cover creating ability of the fill yarn by an observer using a light box for background illumination of the fabric. A 1–10 rating system was used with a rating of 1 given to the control fabric (Comparative Example O) and higher numbers given to indicate visually better covering power. The resulting fabric was visually rated for cover power. Properties for and observations on this fabric are summarized in Table 2.

Comparative Example K

A fabric was constructed from the Comparative Example H yarns in the warp direction with 19.5 ppi and Comparative Example E yarns in the fill direction with 21 ppi. The fabric was visually rated for cover creating ability of the fill yarn by an observer using a light box for background illumination of the fabric. A 1–10 rating system was used with a rating of 1 given to the control fabric (Comparative Example O) and higher numbers given to indicate visually better covering power. The resulting fabric was visually rated for cover power. Properties for and observations on this fabric are summarized in Table 2.

Comparative Example L

A fabric was constructed from the Comparative Example H yarns in the warp direction with 19.5 ppi and Comparative Example F yarns in the fill direction with 21 ppi. The fabric was visually rated for cover creating ability of the fill yarn by an observer using a light box for background illumination of the fabric. A 1–10 rating system was used with a rating of 1 given to the control fabric (Comparative Example O) and higher numbers given to indicate visually better covering power. The resulting fabric was visually rated for cover power. Properties for and observations on this fabric are summarized in Table 2.

Comparative Example M

A fabric was constructed from the Comparative Example H yarns in the warp direction with 19.5 ppi and Comparative Example G yarns in the fill direction with 21 ppi. The fabric was visually rated for cover creating ability of the fill yarn by an observer using a light box for background illumination of the fabric. A 1–10 rating system was used with a rating of 1 given to the control fabric (Comparative Example O) and higher numbers given to indicate visually better covering power. The resulting fabric was visually rated for cover power. Properties for and observations on this fabric are summarized in Table 2.

Comparative Example N

A fabric was constructed from the Comparative Example H yarns in the warp direction with 19.5 ppi and Comparative Example I yarns in the fill direction with 21 ppi. The fabric was visually rated for cover creating ability of the fill yarn by an observer using a light box for background illumination of the fabric. A 1–10 rating system was used with a rating of 1 given to the control fabric (Comparative Example O) and higher numbers given to indicate visually better covering power. The resulting fabric was visually rated for cover power. Properties for and observations on this fabric are summarized in Table 2.

Comparative Example O

A fabric was constructed from the Comparative Example H yarns in the warp direction with 19.5 ppi and Comparative Example A yarns in the fill direction with 21 ppi. The fabric was visually rated for cover creating ability of the fill yarn by an observer using a light box for background illumination of the fabric. A 1–10 rating system was used with a rating of 1 given to the control fabric (Comparative Example O) and higher numbers given to indicate visually better covering power. The resulting fabric was visually rated for cover power. Properties for and observations on this fabric are summarized in Table 2.

TABLE 2

FABRICS AND COVER RATINGS
FOR: (19.5 warp yarns/inch) × (21 fill yarns/inch)
FABRIC CONSTRUCTION

| Example | (warp × fill) | cover rating | comment |
|---|---|---|---|
| 4 | H × 3 | 9.5 | Higher cover ability than Ex. K. Over-fills construction in a way not seen in Ex. J. Uniform appearance. No voids in fabric. |
| J | H × D | 9.5 | Higher cover ability than Ex. K. Fills construction with fill inferior to Ex. 4. Uniform appearance. No voids in fabric. |
| K | H × E | 7 | Higher cover ability than Ex. L. Fills fabric construction with fill inferior to Ex. 4. Uniformity slightly inferior to Ex. J. No voids in fabric. |
| L | H × F | 5 | Higher cover ability than Ex. M. Fills fabric construction with fill inferior to Ex. 4. Some slight voids in construction. |
| M | H × G | 3 | Just slightly better cover than Ex. N. Some voids noted in construction and some non-uniformity. |
| N | H × I | 2 | Just slightly better cover than "control" with voids in fabric. |
| O | H × A (control) | 1 | Well-distributed voids in construction of fabric. |

Table 2 summarizes the cover properties of 7 signage fabrics constructed with Comparative Example H yarns in the warp of the fabric (19.5 warp yarns per inch) and a variety of fill yarns, including the invention, at 21 fill yarns per inch. Example O was the control fabric. The control fabric, Example O (=H X A) was visually rated for fabric cover and assigned a rating of 1. The control was described by comments appropriate to this subjective cover rating of 1 versus the other examples. The control fabric showed open fabric voids which were well-distributed throughout the fabric. The distribution of voids or spaces between yarns comprising the fabric allowed some light transmission when viewed against a light box, but appearance was otherwise uniform.

EXAMPLE 5

A fabric was constructed from the Comparative Example H yarns in the warp direction with 19.5 ppi and the Example 1 yarns in the fill direction with 17.8 ppi. Comments comparing the cover power of this fabric to other fabrics are provided in Table 3. Further, the % weight reduction of this fabric versus the weight of Comparative Example O (control) fabric was calculated and is presented in Table 4.

EXAMPLE 6

A fabric was constructed from the Comparative Example H yarns in the warp direction with 19.5 ppi and the Example 2 yarns in the fill direction with 15.8 ppi. Comments comparing the cover power of this fabric to other fabrics are provided in Table 3. Further, the % weight reduction of this fabric versus the weight of Comparative Example O (control) fabric was calculated and is presented in Table 4.

Comparative Example O

A fabric was constructed from the Comparative Example H yarns in the warp direction with 19.5 ppi and the Comparative Example A yarns in the fill direction with 21.0 ppi. Comments comparing the cover power of this fabric to other fabrics are provided in Table 3.

TABLE 3

FABRICS AND COVER RATINGS
Control = O = H × A,
(19.5 warp yarns/inch) × (21 fill yarns/inch)
Invention = H in warp, (19.5 warp yarns/inch) × (indicated fill yarns/inch)

| Example | fabric construction (warp × fill) | fill yarns/inch | comments |
|---|---|---|---|
| 5 | H × 1 | 17.8 | Slightly better cover than control despite reduced fill yarn in fabric. Smooth uniform appearance with no fabric voids. |
| 6 | H × 2 | 15.8 | Slightly better cover than control. Smooth uniform appearance with no fabric voids. |
| O | H × A (Control) | 21.0 | Uniform cover with well distributed fabric voids. |

In Table 3, the cover and appearance performance of 3 fabrics, Examples 5 and 6 and the control fabric Example O are summarized. Examples 5 and 6 show that an entirely commercially satisfactory fabric cover and appearance are obtained from the sinusoidal cross section filament yarns, even when present at a reduced fill-yarn count, versus round cross section filament yarns of denser weave. This result is surprising in view of the generally accepted strategy of using dense weaves to obtain more cover. Denser weaves are, however, produced at some additional expense. More fill yarns present in a weave slow the weaving process since the weaving machine requires more time to introduce the fill yarns. This result of Examples 5 and 6 demonstrated a faster weaving process is obtainable since the fill yarn count is reducible at a constant appearance property for the fabric. Furthermore, this reduced fill yarn count translates into a fabric weight savings versus higher fill counts.

EXAMPLE 7

A fabric is constructed from the Example 2 yarns in the warp direction with 15.8 ppi and the Example 1 yarns in the fill direction with 15.8 ppi. The % weight reduction of this fabric versus the weight of Comparative Example O (control) fabric was calculated and is presented in Table 4.

TABLE 4

| Example | FABRIC WEIGHT REDUCTION O = Control warp yarns per inch | fill yarns per inch | % weight reduction vs. control (O) |
|---|---|---|---|
| O (=H × A) | 19.5 | 21 | n/a |
| 5 (=H × 1) | 19.5 | 17.8 | 13.6 |
| 6 (=H × 2) | 19.5 | 15.8 | 7.9 |
| 7 (=2 × 1) | 15.8 | 15.8 | >17 |

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An industrial filament, comprising:

a synthetic melt spun polymer having a relative viscosity about 24 to about 42, a denier of about 4 to about 8, a tenacity of about 6.5 grams/denier to about 9.2 grams/denier, and a sinusoidal shaped cross section normal to a longitudinal axis of the filament, the cross section having an aspect ratio of about 2 to about 6.

2. The industrial filament of claim 1, wherein the aspect ratio is about 2.5 to about 5.

3. The industrial filament of claim 1, wherein the aspect ratio (AR) is defined as a ratio of a first dimension (A) to a second dimension (B) where the first dimension (A) is defined as a length of a straight line segment connecting first and second points in the periphery of the filament cross section that are farthest from one another and the second dimension B is 2r where r is the sum of the radius r1 of a first outer convex edge of the filament and the radius r2 of a second outer convex edge of the filament.

4. The industrial filament of claim 1, wherein the polymer consists essentially of poly(ethylene terephthalate).

5. The industrial filament of claim 1, wherein the denier is about 6 grams to about 7.2 grams.

6. The industrial filament of claim 1, wherein the tenacity is about 7.5 grams/denier to about 8.0 grams/denier.

7. The industrial filament of claim 1, comprising a dry heat shrinkage of about 2% to about 16% at 30 minutes at 177° C.

8. An industrial yarn, comprising:

a plurality of industrial filaments, each of the filaments comprising:

a synthetic melt spun polymer having a relative viscosity about 24 to about 42, a denier of about 4 to about 8, a tenacity of about 6.5 grams/denier to about 9.2 grams/denier, and a sinusoidal shaped cross section normal to a longitudinal axis of the filament, the cross section having an aspect ratio of about 2 to about 6.

9. The industrial yarn of claim 8, wherein the filaments are positioned in a tile arrangement such that ends of a first set of the filaments are near, and aligned with, ends of a second set of the filaments such that pairs of the first set of the filaments and the second set of the filaments are positioned substantially along sinusoidal lines.

10. The industrial yarn of claim 8, wherein the filaments are positioned in a tile arrangement such that inner concave surfaces of a first set of the filaments contact inner concave surfaces of a second set of the filaments, outer convex surfaces of the first set of the filaments contact outer convex surfaces of the second set of the filaments, such that the first set of the filaments and the second set of the filaments are positioned in a locked arrangement.

11. An industrial fabric, comprising:

a plurality of first industrial yarns in a warp direction;

a plurality of second industrial yarns in a fill direction weaved with the first industrial yarns; and at least some of the first industrial yarns and/or at least some of the second industrial yarns comprising a plurality of industrial filaments, each of the filaments comprising:

a synthetic melt spun polymer having a relative viscosity about 24 to about 42, a denier of about 4 to about 8, a tenacity of about 6.5 grams/denier to about 9.2 grams/denier, and a sinusoidal shaped cross section normal to a longitudinal axis of the filament, the cross section having an aspect ratio of about 2 to about 6.

12. The industrial fabric of claim 11, wherein at least the first industrial yarns or the second industrial yarns comprise a plurality of the industrial filaments, whereby the fabric has a reduction in total weight by at least 7% compared to a fabric made entirely from yarns comprising other filaments which are essentially the same as the industrial filaments, except the other filaments having circular cross sections.

13. The industrial fabric of claim 11, wherein the first industrial yarns and the second industrial yarns comprise a plurality of the industrial filaments, whereby the fabric has a reduction in total weight by at least 13% compared to a fabric entirely made from yarns comprising other filaments which are essentially the same as the industrial filaments, except the other filaments having circular cross sections.

* * * * *